US006875963B2

(12) United States Patent
Rock et al.

(10) Patent No.: US 6,875,963 B2
(45) Date of Patent: Apr. 5, 2005

(54) ELECTRIC HEATING/WARMING FABRIC ARTICLES

(75) Inventors: Moshe Rock, Brookline, MA (US); Vikram Sharma, Stoneham, MA (US)

(73) Assignee: Malden Mills Industries, Inc., Lawrence, MA (US)

( * ) Notice: Subject to any disclaimer, the term of this patent is extended or adjusted under 35 U.S.C. 154(b) by 244 days.

(21) Appl. No.: 10/082,820

(22) Filed: Feb. 25, 2002

(65) Prior Publication Data

US 2002/0117493 A1 Aug. 29, 2002

Related U.S. Application Data

(60) Continuation-in-part of application No. 09/389,761, filed on Sep. 2, 1999, now Pat. No. 6,389,681, which is a division of application No. 09/298,722, filed on Apr. 23, 1999, now Pat. No. 6,111,233.

(60) Provisional application No. 60/270,846, filed on Feb. 23, 2001.

(51) Int. Cl.[7] ..... H05B 3/54

(52) U.S. Cl. ..... 219/545; 219/211; 219/212; 219/529; 219/543; 219/549; 392/435

(58) Field of Search ..... 219/545, 203, 219/211, 212, 213, 217, 527, 528, 529, 543, 544, 549; 392/425, 432, 435; 28/91.1

(56) References Cited

U.S. PATENT DOCUMENTS

| | | | | |
|---|---|---|---|---|
| 3,513,297 A | | 5/1970 | Jordan | |
| 3,697,728 A | | 10/1972 | Stirzenbecher | |
| 3,729,613 A | | 4/1973 | Deloire et al. | |
| 3,869,596 A | | 3/1975 | Howie | |
| 3,978,183 A | | 8/1976 | Erickson | |
| 3,983,527 A | * | 9/1976 | Ohsato et al. | 219/203 |
| 4,021,640 A | | 5/1977 | Gross et al. | |
| 4,044,221 A | | 8/1977 | Kuhn | |
| 4,061,898 A | | 12/1977 | Murray et al. | |
| 4,065,660 A | | 12/1977 | Berard | |
| 4,245,149 A | | 1/1981 | Fairlie | |
| 4,272,673 A | | 6/1981 | Semanaz et al. | |
| 4,320,286 A | | 3/1982 | Borrup | |
| 4,429,216 A | * | 1/1984 | Brigham | 219/528 |
| 4,485,297 A | | 11/1984 | Grise et al. | |
| 4,512,827 A | * | 4/1985 | Gill | 219/544 |
| 4,590,359 A | | 5/1986 | Mobius | |
| 4,656,339 A | | 4/1987 | Grise | |
| 4,713,527 A | * | 12/1987 | Kicherer et al. | 219/544 |
| 4,713,531 A | | 12/1987 | Fennekels et al. | |
| 4,736,088 A | | 4/1988 | Bart | |
| 4,764,665 A | | 8/1988 | Orban et al. | |
| 4,774,397 A | | 9/1988 | Grise | |
| 4,814,586 A | | 3/1989 | Grise | |
| 4,849,255 A | | 7/1989 | Grise et al. | |
| 4,857,384 A | | 8/1989 | Mio et al. | |
| 4,888,089 A | | 12/1989 | Marstiller et al. | |

(Continued)

FOREIGN PATENT DOCUMENTS

| | | |
|---|---|---|
| DE | 197 45 889 A1 | 4/1999 |
| EP | 0 571 978 A1 | 1/1993 |

*Primary Examiner*—Fadi H. Dahbour
(74) *Attorney, Agent, or Firm*—Fish & Richardson P.C.

(57) ABSTRACT

Electric heating/warming composite fabric articles have at least a fabric layer having inner and outer surfaces, and an electric heating/warming element in the form of a flexible, preferably stretchable, electricity-conducting film disposed at the inner surface of the fabric layer and adapted to generate heating/warning when connected to a power source. A barrier layer may be positioned, for example, adjacent to the inner surface of the fabric layer; e.g., with the electric heating/warming element formed thereupon, including to protect the electric circuit, e.g. against abrasion. Methods of forming electric heating/warming composite fabric articles are also described.

18 Claims, 7 Drawing Sheets

U.S. PATENT DOCUMENTS

| | | | | |
|---|---|---|---|---|
| 4,892,998 | A | | 1/1990 | Marstiller et al. |
| 4,912,306 | A | | 3/1990 | Grise et al. |
| 4,950,868 | A | | 8/1990 | Moss et al. |
| 4,983,814 | A | | 1/1991 | Ohgushi et al. |
| 5,019,797 | A | | 5/1991 | Marstiller et al. |
| 5,081,339 | A | | 1/1992 | Stine |
| 5,151,578 | A | | 9/1992 | Phillips |
| 5,298,722 | A | | 3/1994 | Tanaka |
| 5,364,678 | A | | 11/1994 | Lumb et al. |
| 5,432,322 | A | | 7/1995 | Ingram et al. |
| 5,477,033 | A | * | 12/1995 | Bergholtz ..... 219/549 |
| 5,484,983 | A | | 1/1996 | Roell |
| 5,679,277 | A | | 10/1997 | Niibe et al. |
| 5,845,342 | A | * | 12/1998 | Park ..... 219/211 |
| 5,925,275 | A | | 7/1999 | Lawson et al. |
| 6,111,233 | A | | 8/2000 | Rock et al. |
| 6,150,643 | A | * | 11/2000 | Kitamura et al. ..... 219/544 |
| 6,229,123 | B1 | | 5/2001 | Kochman et al. |
| 6,791,066 | B2 | * | 9/2004 | Hawk ..... 219/203 |

* cited by examiner

ELECTRIC HEATING/WARMING FABRIC ARTICLES

CLAIM OF PRIORITY

This application claims benefit from U.S. Provisional Application No. 60/270,846, filed Feb. 23, 2001. This application is: a continuation-in-part of U.S. application Ser. No. 09/389,761, filed Sep. 2, 1999 now U.S. Pat. No. 6,389,681, which is a division of U.S. application Ser. No. 09/298,722, filed Apr. 23, 1999, now U.S. Pat. No. 6,111,233, issued Aug. 29, 2000. The complete disclosures of all of the above-listed patents and patent applications are incorporated herein by reference.

TECHNICAL FIELD

This invention relates to electric fabric articles for heating/warming.

BACKGROUND OF THE INVENTION

Techniques known for augmenting heating/warming capabilities of clothing fabric include adding electric wires to the fabric, typically by incorporating the wires directly into the fabric or by attaching the wires to the fabric, e.g., by sewing. It is also known, e.g., from Gross et al. U.S. Pat. No. 4,021,640, to print an electrical circuit with a resistance heating element on a sheet of plastic, such as MYLAR, and to incorporate strips of the plastic sheet into a fabric article, such as a glove.

SUMMARY OF THE INVENTION

It is an objective of this invention to provide an electric heating/warming composite fabric article which is windproof, water-resistant and water vapor permeable, and, in selected applications, stretchable.

It is a further objective of this invention to provide an electric heating/warming element formed of a material which is flexible, washable, non-swelling and hydrophobic, and, preferably, stretchable, that may be deposited on the surface of a fabric layer, or on the surface of a barrier layer that is, or may after be, adhered to a fabric layer.

Other objectives of the invention include to provide a heating/warming composite fabric article which is stretchable, making it comfortable to wear; to provide a heating/warming composite fabric article which is waterproof, but also vapor permeable, e.g., making it particularly suitable for use in winter garments; and to provide a heating/warming composite fabric article in which the heating/warming elements are resistant to stiffening and cracking at low temperatures.

Other features and advantages of the invention will be apparent from the following description of a presently preferred embodiment.

BRIEF DESCRIPTION OF THE DRAWINGS

FIG. 12 is a somewhat diagrammatic exploded side edge view of the components forming another embodiment of a heating/warming composite fabric article constructed in accordance with the invention, while

DETAILED DESCRIPTION

Figure 1:
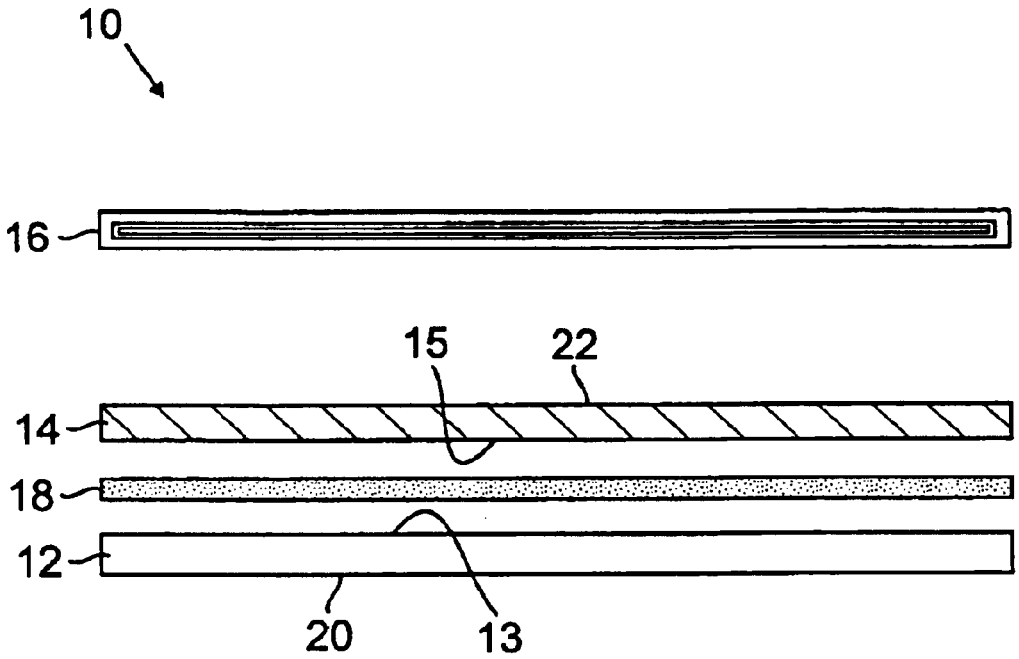
FIG. 1 is a somewhat diagrammatic exploded side edge view of the components forming a first embodiment of a heating/warming composite fabric article constructed in accordance with the invention.
Figure 2:
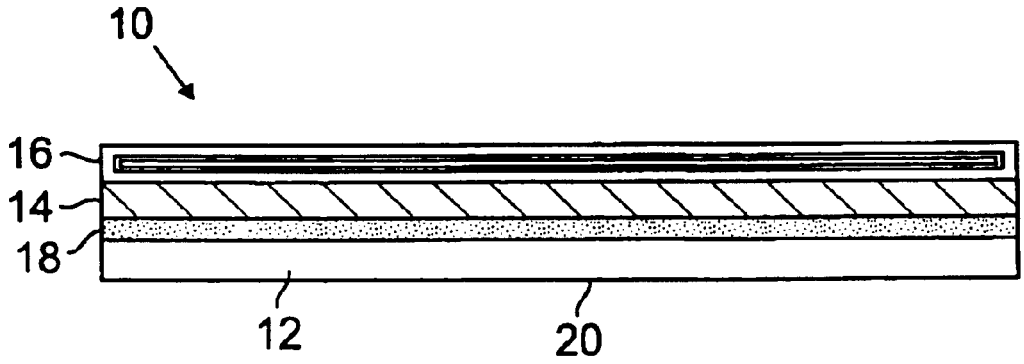
FIG. 2 is a somewhat diagrammatic side edge view of the heating/warming composite fabric article of FIG. 1.

Referring first to FIGS. 1 and 2, in a first embodiment, a stretchable, windproof, water-resistant, and vapor permeable electric heating/warming composite fabric article 10 constructed in accordance with this invention has three major components. These components include a fabric layer 12, a barrier layer 14 and an electric heating/warming element 16, the fabric layer 12 and barrier layer 14 being joined at opposed fabric inner surface 13 and barrier outer surface 15, respectively, by adhesive 18.

In preferred embodiments, the outer fabric layer 12 is made in any well known manner, e.g. the fabric layer 12 may be a knitted material, e.g., a plaited circular knitted or reverse plaited circular knitted material, or other circular knitted material (such as double knitted, single jersey knitted, two-end fleece knitted, three-end fleece knitted, terry knitted or double loop knitted material), or warp knitted or weft knitted material, or a woven or non-woven material. In applications where the fabric layer 12 of the fabric article 10 will be directed outwardly, away from the wearer's skin, the material of the fabric layer is preferably hydrophobic, in order to resist penetration of liquids. In other applications, where the fabric layer 12 of the fabric article 10 will be directed inwardly, toward the wearer's skin, the material of the fabric layer is preferably naturally hydrophilic, chemically rendered hydrophilic, or hydrophobic, in order to enhance removal and transport of perspiration away from the skin. The inner surface 13 of fabric layer 12, to which the adhesive 18 is adhered, is preferably flat. The exposed, outer surface 20 of fabric layer 12 may be flat or raised, e.g. by brushing, sanding or napping, and/or may be otherwise provided with decorative and functional features and finishes, e.g. as well known in the art.

Preferably, the barrier layer 14 is formed of a vapor permeable membrane which is nonporous hydrophilic or micro-porous hydrophobic or a combination of both, e.g. in layers, as appropriate to the nature of the intended use, or as otherwise desired. In many embodiments, it is also preferred that the material of the barrier layer 14 be soft and stretchable. The barrier layer is constructed and/or formulated to resist air and water droplets from passing through the composite fabric article 10 while being permeable to water vapor. In applications where it is desired that the fabric article 10 is stretchable, the fabric layer 12 may typically be a knitted material, and a preferred material for barrier layer 14 is poly urethane, e.g. as available from UCB Chemical Corp. of Drogenbos, Belgium, either micro-porous hydrophobic (preferred for use where the barrier layer 14 is directed outward) or nonporous hydrophilic (preferred for use where the barrier layer 14 is directed inward). Alternatively, in situations where relatively less stretch is required, e.g. in footwear, the fabric layer 12 may be a warp knitted material, and a preferred material for barrier layer 14 is poly tetrafluoroethylene (PTFE), e.g., as available from Tetratec, of Feasterville, Pa.

The barrier layer 14 is joined to the inner surface 13 of fabric layer 12 by adhesive 18, typically applied in spots, lines or other discrete regions, or by attachment, lamination or other suitable manner of combining. A similar composite fabric (but having an additional internal fabric layer) is described in commonly assigned Lumb et al. U.S. Pat. No. 5,364,678, the entire disclosure of which is incorporated herein by reference.

Figure 3:
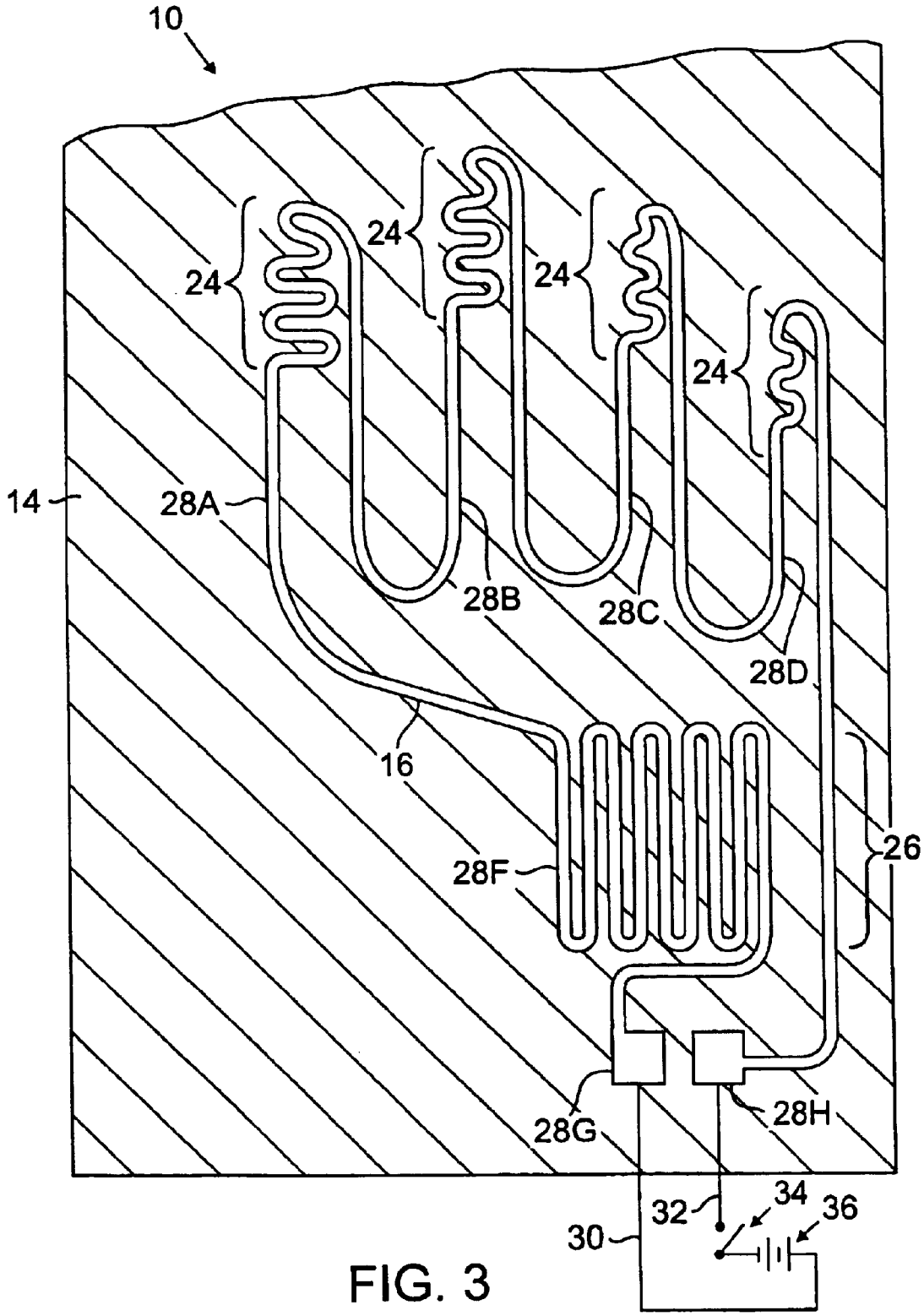
FIGS. 3, 4 and 5 are somewhat diagrammatic front plan views of the inner surfaces of heating/warming composite fabric articles of FIGS. 1 and 2, with electric heating/warming elements formed thereupon, e.g., for a glove (FIG. 3), for an article of footwear (FIG. 4), and for a garment such as a shirt or jacket (FIG. 5)

Referring also to FIG. 3, electric heating/warming element 16 is disposed upon the outer surface 22 of barrier layer 14. The electric heating/warming element 16 is preferably formed of an electrically conductive paste having sufficient electrical resistivity when deposited upon the surface of the barrier layer to generate a level of heat/warmth suitable for its intended purpose. For example, electrical resistivity of the conductive paste after printing and curing in the range of 100 (1×102) ohm-cm to 0.000001 (1×10−6) ohm-cm is considered suitable for use in most applications; however, conductive pastes performing outside this range can be employed, where required or desired. In the preferred embodiment, the paste is a silicone-based resin containing silver, graphite and/or other conductive particles, e.g. as available under the designation X171484 from Loctite Corporation, of Rocky Hill, Conn.

Preferably, the heating/warming element 16 is applied upon the surface 22 in the form of a paste by screen printing in a predetermined pattern. After the paste is applied upon the surface 22 of the barrier layer 14, the paste is cured to form the heating/warming element 16 as a thin film which is very flexible and can be bent and/or stretched without cracking or otherwise adversely affecting the electrical circuit. After curing, the fabric article 10, including the heating/warming element 16 thereupon, is washable, and the heating/warming element 16 is non-swelling and hydrophobic. Preferably, the conductive paste is formulated also to resist stiffening and cracking upon exposure to low temperatures, e.g. such as those experienced in northern climes.

The predetermined screen printing pattern of the heating/warming element 16 may be custom designed for the particular use and purpose of the garment for which the composite fabric article 10 of the invention is to be used. For example, the pattern of the heating/warming element 16 of the composite fabric article 10 of FIG. 3 is designed for use in making a glove. For this purpose, the electric heating/warming element 16 is printed to form a pattern having four elongated branches 28A, 28B, 28C, 28D (corresponding to fingers of a glove) and one or more labyrinth or zig-zag sections 28F (corresponding to the palm or back of the body of a glove). The heating/warming element 16 is formed as a continuous filament or circuit, terminating at each end in a contact pad 28G, 28H, respectively, which preferably are disposed adjacent to each other in a region convenient for connection to a source of power, e.g. for a glove, as shown, in a region to form the wrist of the glove. Still referring to FIG. 3, the heating/warming element 16 is connected, by wire conductors 30, 32 extending from contact pads 28G, 28H, respectively, in a circuit including a switch 34 and a power supply, e.g., a battery pack 36. When switch 34 is closed, the heating/warning element 16 is activated to generate heat/warmth.

The pattern features of the heating/warming element 16 shown in FIG. 3 are sized and shaped to conform to the regions of the resulting fabric article, i.e., the glove, so that the composite fabric can readily be cut to form one side of a glove. Patterns for use in other types and sizes of garments and fabric articles, e.g. such as socks, sweaters, jackets, shirts, pants, hats, gloves, footwear (e.g. shoes and boots) and so on, can be generated in a similar manner.

Figure 4:
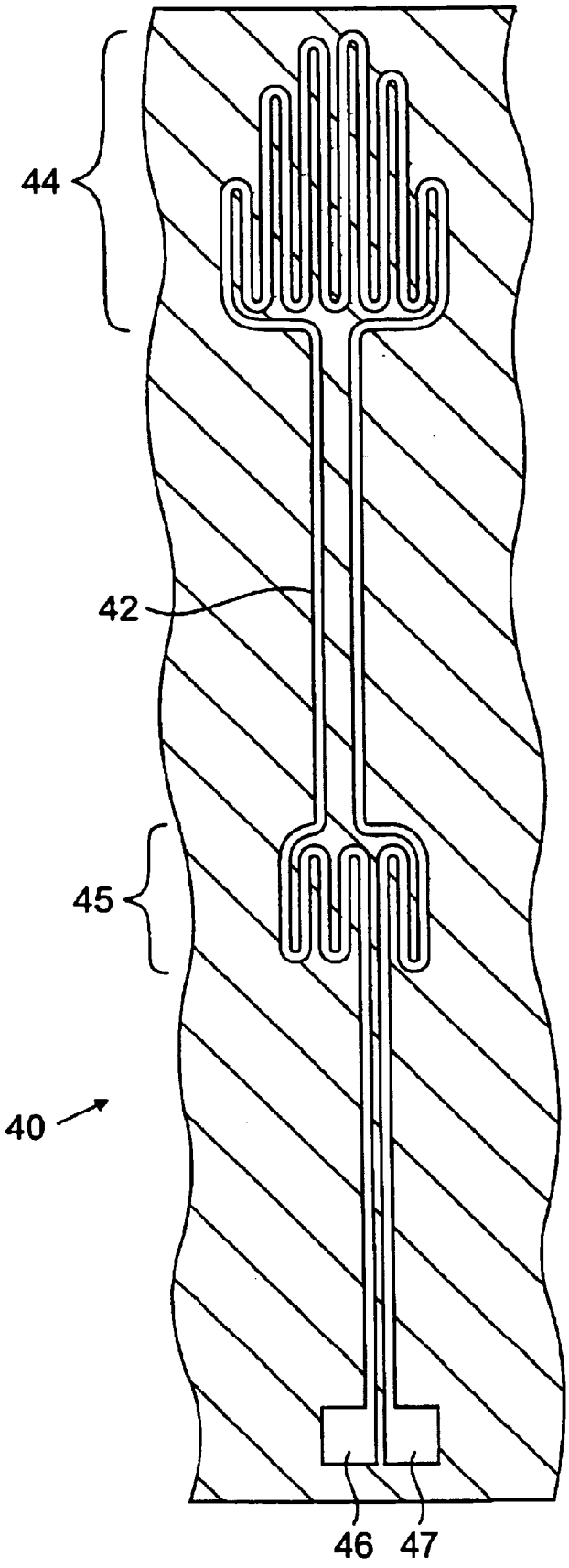

For example, referring to FIG. 4, a composite fabric article 40 of the invention has a heating/warming element 42 sized and shaped to conform to the regions of the selected resulting fabric article, i.e., in this embodiment, a boot, to be heated/warmed so that the composite fabric can readily be cut to be formed and/or incorporated into a boot liner. In particular, the heating/warming element 42 has heating/warming regions 44, 45 of concentrated zig-zag conductor filaments corresponding to the toe/ball and heel surfaces, respectively, of a wearer's foot. The heating/warming element 42, which is formed as a continuous circuit, terminates at each end in a contact pad 46, 47, respectively, which are disposed adjacent to each other in a region convenient for connection to a source of power, e.g., as shown, in a region to extend into or above the ankle collar of the boot.

Figure 5:
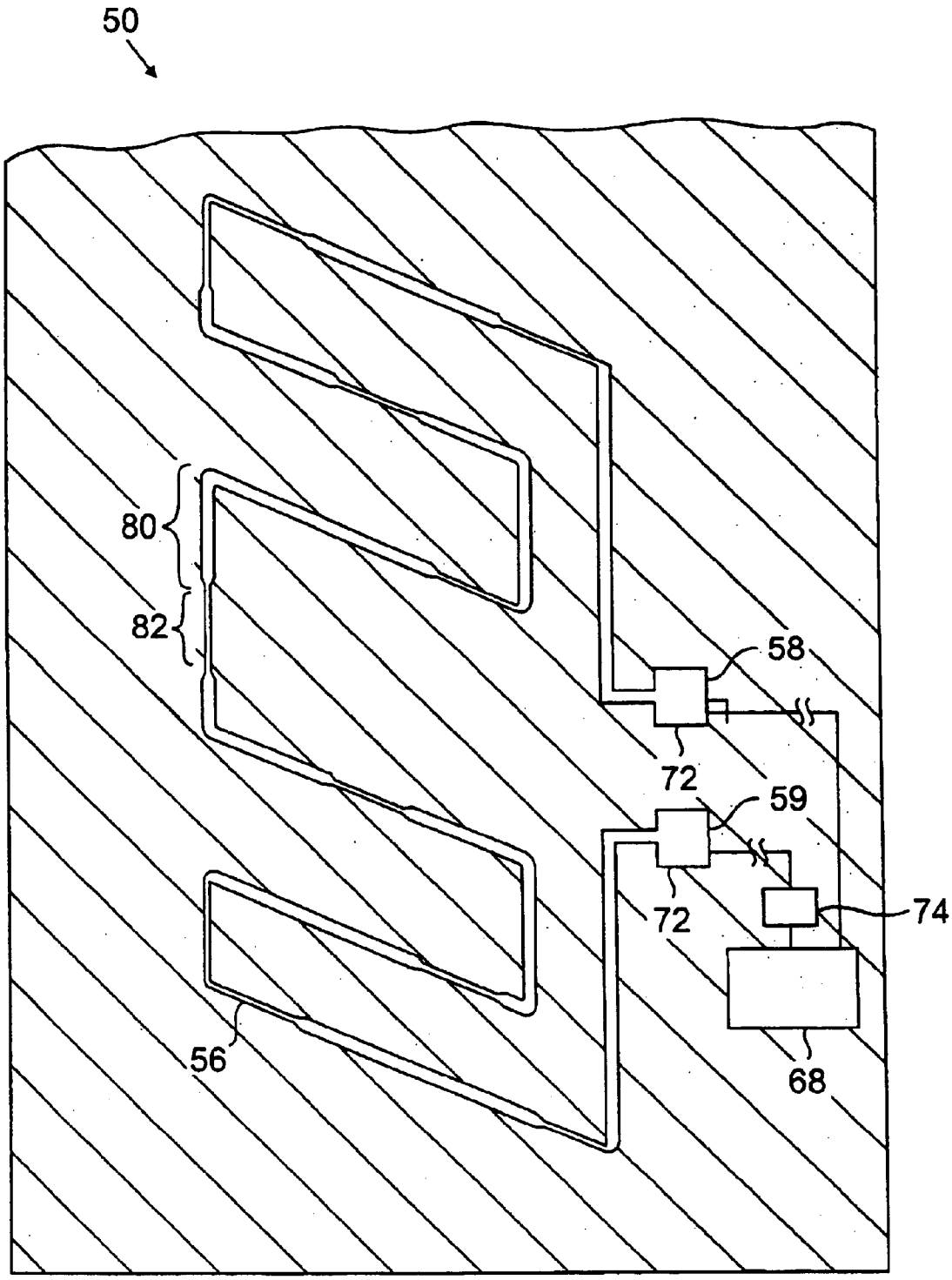

Referring finally to FIG. 5, a composite fabric article 50 of the invention has a heating/warming element 56 sized and shaped to conform to the regions of the selected resulting fabric article, i.e., in this embodiment, the opposite chest surfaces of a garment such as a shirt or a jacket 60 (FIG. 6), to be heated/warmed. The heating/warming element 56, which is formed as a continuous circuit, terminates at each end in a contact pad 58, 59, respectively, which are disposed adjacent to each other in a region convenient for connection to a source of power, as discussed below.

Figure 6:
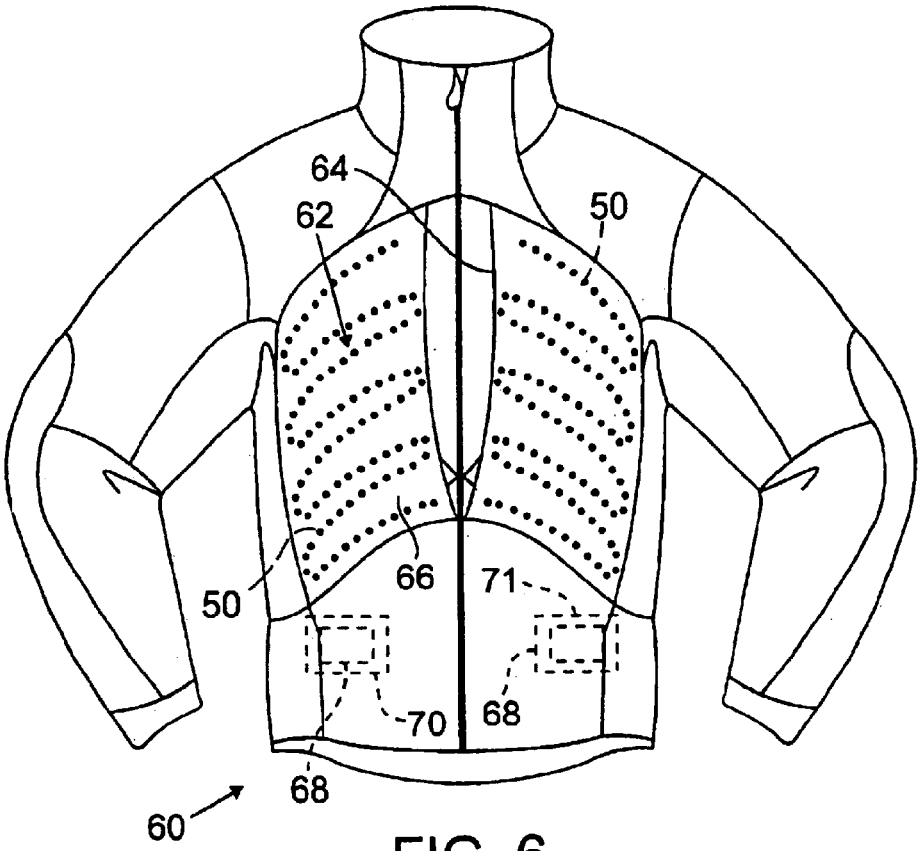
FIG. 6 is a somewhat diagrammatic front view of a garment, i.e., a jacket, incorporating the heating/warming composite fabric article of FIG. 5.

Referring also to FIG. 6, a pair of fabric articles 50 are shown incorporated into jacket 60. A battery pack 68 for powering each of the heating/warming composite fabric articles 50 is contained in the associated zippered pockets 70, 71. The battery pack 68, e.g. as available from Polaroid Corporation, of Cambridge, Mass., is preferably removably connected to the contact pads 58, 59 of heating/warming element 56 by releasable fastening elements 72, e.g. clips, snaps or other secure but releasable fastening elements. (The fastening elements may provide the electrical connection of the battery pack to the circuit, or, alternatively, may maintain the battery pack in position for contact of the battery pack with separate connectors.) This arrangement permits the battery pack 68 to be removed, e.g., whenever the fabric article 50 is to be washed, or for replacement. The heating/warming circuit 56 may also include an oscillator chip 74 or other timing or cycling device for cycling application of electrical power from the battery pack 68 to the heating/warming element 56, e.g., to extend battery pack life. For example, a timing cycle of three minutes "on" followed by one minute "off" is considered suitable for an electric heating/warming composite fabric article 50 incorporated as a chest panel of the heating/warm jacket 60 suited for outdoors use.

In one preferred embodiment, a composite fabric article 10 of the invention is formed by first combining the fabric layer 12 and barrier layer 14 with adhesive 18 disposed therebetween. An electric heating/warming element 16 is then formed, e.g. by screen printing a conductive paste in a predetermined pattern, on the surface 22 of the barrier layer 14. The printed pattern is then cured to form an electric heating/warming element 16 which is flexible, washable, non-swelling and hydrophobic, which is also resistant to stiffening or cracking at lower temperatures, and which preferably is also stretchable. The resulting composite fabric article 10 is cut to shape, and otherwise processed using standard clothing procedures, for incorporation, e.g., into an article of clothing or the like.

Alternatively, the heating/warming element 16 may be formed on the surface 22 of the barrier layer 14 and cured, before the barrier layer 14 and the fabric layer 12 are secured together.

Figure 7:
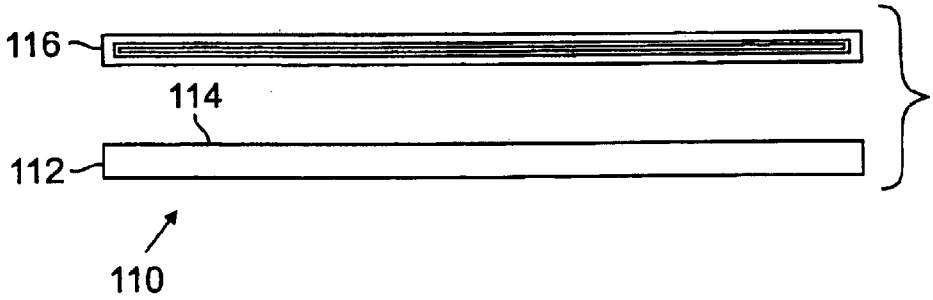
FIG. 7 is a somewhat diagrammatic exploded side edge view of the components forming another embodiment of a heating/warming composite fabric article constructed in accordance with the invention.
Figure 8:
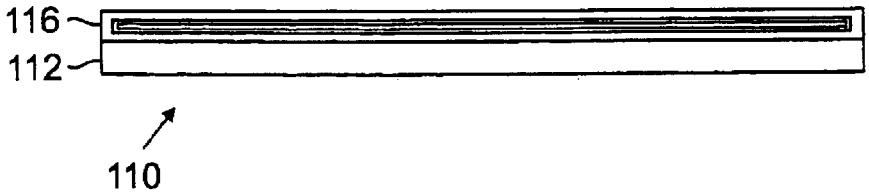
FIG. 8 is a somewhat diagrammatic side edge view of the heating/warming composite fabric article of FIG. 7.

Referring next to FIGS. 7 and 8, in another embodiment of the invention, an electric heating/warming composite fabric article 110 consists of a fabric layer 112 having an inner surface 114 upon which is applied, e.g. as a conductive paste, by screening printing, an electric heating/warming element 116.

In embodiments of the invention where the heating/warming element 116 is applied directly to the fabric layer 112, the composite fabric article 110 may be employed without a barrier layer. Alternatively, a pair of fabric articles 110 may be incorporated into garment, e.g. a jacket 60, as shown in FIG. 6, where the outer coverings 62, 64 of the opposite chest surfaces of the jacket may be a shell material selected to provide a barrier layer overlaying the heating/warming composite fabric articles 110 incorporated into the jacket.

The relative amounts of heat/warmth generated by a region of an electrical heating/warming element in a composite heating/warning fabric article of the invention can be controlled, e.g., by varying the length and/or width and/or thickness of a circuit element filament or segment, and/or by varying the conductivity/resistivity of the material forming a segment of the circuit element. For example, referring to FIG. 5, a heating/warming element 56 is formed of a paste material of uniform conductivity applied to form a film of constant thickness having regions 80 and 82 of contrasting width, and, therefore, contrasting cross sectional area. As a result, in region 80 of relatively greater width, there is more conductivity, i.e. less resistance to current flow, and thus less generation of heat/warmth. Similarly, in region 82 of relatively lesser width, there is less conductivity, i.e. more resistance to current flow, and thus relatively greater generation of heat/warmth. As a result, a composite heating/warming fabric article 50 of the invention can be designed with a circuit element 56 that delivers relatively greater amounts of heat/warmth to selected regions of the wearer's body.

In other embodiments, this effect may also or instead be achieved by concentrating a relatively greater length of relatively narrow circuit element filaments, e.g. in a tortuous, zig-zag and/or interlocking spiral pattern, in a region of greater heat requirement. For example, referring to FIG. 4, a zig-zag circuit pattern is provided in regions 44, 45 corresponding to toe/ball and heel surfaces, respectively, of a composite heating/warming fabric article 40 of the invention, i.e., a boot liner; and also, referring to FIG. 3, in the fingertip regions 24 and hand surface region 26 of a composite heating/warming fabric article 10 of the invention, i.e., a glove.

Figure 9:
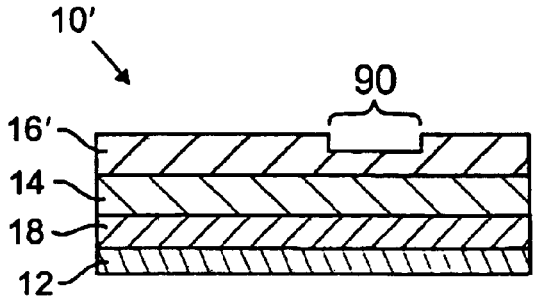
FIG. 9 is a somewhat diagrammatic side edge view of another embodiment of a heating/warming composite fabric article constructed in accordance with the invention.
Figure 10:
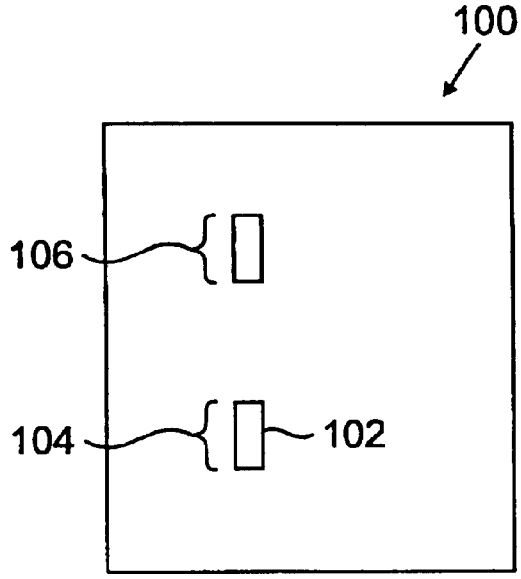
FIGS. 10 and 11 are sequential, somewhat diagrammatic front plan views of the inner surface of a heating/warming composite fabric article during construction in accordance with another embodiment the invention.
Figure 11:
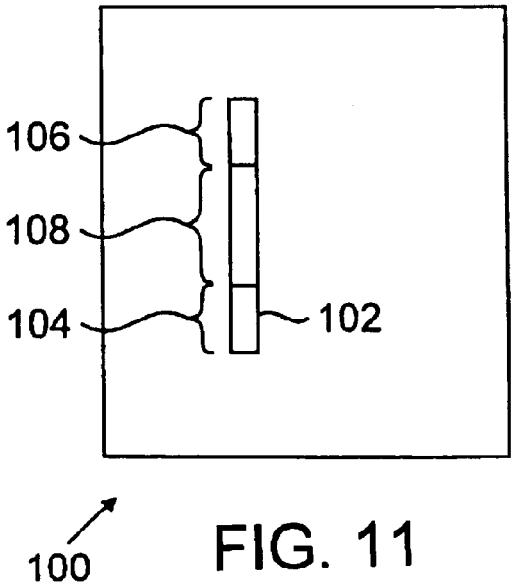

Alternatively, this effect may be obtained by applying a thinner region of conductive paste, i.e., a region of relatively lesser cross sectional area. For example, referring to FIG. 9, a composite heating/warming fabric article 10' of the invention has a heating/warming element 16' having a region 90 of relatively lesser thickness (compared to adjacent regions). Alternatively, or in addition, a heating/warming element of constant dimension but with regions generating relatively different levels of heat/warmth may be formed by sequentially applying circuit regions using pastes of inherently different conductivity. For example, referring first to FIG. 10, showing a composite heating/warming fabric article 100 of the invention, a heating/warming element 102 is formed by first applying regions 104, 106 of a conductive paste of relatively greater conductivity, and thereafter, referring to FIG. 11, applying region 108 of a conductive paste of relatively lower conductivity, region 108 interconnecting regions 104, 106, with the conductive pastes being applied, e.g., in the manner in which contrasting colors are applied, in sequential steps in a screen printing process. These and other methods for adjusting the conductivity of electrical circuit regions may be employed alone, or in any desired combination.

Figure 13:
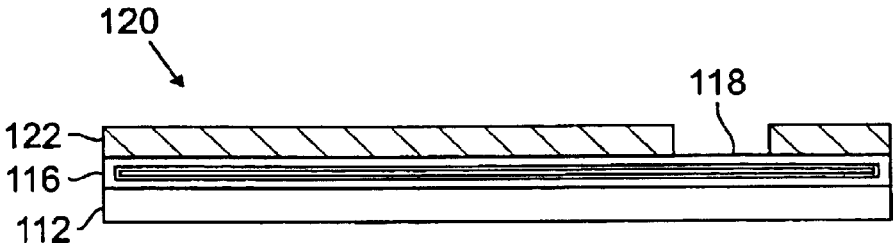
FIGS. 13 and 14 are somewhat diagrammatic side edge views of alternate embodiments of the heating/warming composite fabric article of FIG. 12.
Figure 14:
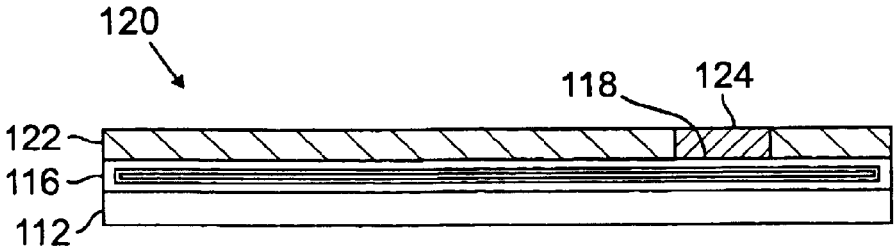

In yet another embodiment of the invention, the electric heating/warming composite fabric article 110 described above with reference to FIGS. 5 and 6 may be further processed. For example, referring now to FIGS. 12, 13 and 14, in an electric heating/warming composite fabric article 120, a barrier layer 122, e.g. as described above, is attached adjacent to the side of the inner surface 114 of the fabric layer, overlying at least a portion of the heating/warming element 116, using adhesive, also as described above. Preferably, contact pads 118 (only one is shown) of heating/warming element 116 are left exposed for connection to a source of power (FIG. 13), or electrical connectors 124 (only one is shown) are provided for connecting the contact pads and power source through the barrier layer 122 (FIG. 14).

In all cases described above, the heating/warming layer is supported by a fabric layer, whether or not a barrier layer is provided. The fabric layer may be naturally hydrophilic, chemically rendered hydrophilic, or hydrophobic. In most preferred embodiments, a barrier layer is provided at least adjacent to the inner surface of the fabric layer, i.e., attached to the fabric layer (with or without intervening materials) or spaced from attachment to or upon the fabric layer, but positioned at the inner surface side of the fabric.

Figure 12:
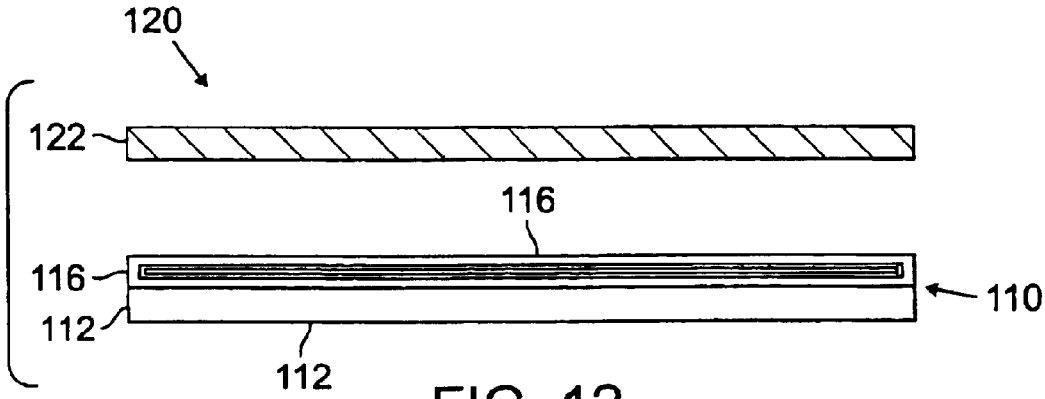

A barrier layer associated with or attached, e.g. by lamination or other techniques, upon the surface of the fabric layer 12 upon which the printed circuit 16 is formed (e.g. barrier layers 62, 64; FIG. 6 and barrier layer 122; FIGS. 12–14, respectively) serves also to protect the circuit against the effects of abrasion that might otherwise deteriorate the quality or continuity of the electrical heating circuit. The barrier layer would also serve to resist short-circuiting in the event that condensate forms on the fabric layer inner surface. The barrier layer may be formed of any suitable, protective material. It will preferably be microporous hydrophobic or nonporous hydrophilic if it is a complete layer. Where a complete layer is not desired or employed, the barrier layer may be applied exclusively to the printed circuit itself, in which case, it will preferably be nonporous hydrophobic.

Other embodiments are also within the invention. For example, the conductive paste may instead be an electrical conductive synthetic resin, e.g. poly aniline, alone or containing conductive particles. Also, additional fabric layers may be added to enhance various esthetics and functional characteristics of the electric heating/warming composite fabric article.

What is claimed is:

1. An electric heating/warming composite fabric article, comprising:

a fabric layer having an inner surface and an outer surface, a barrier layer disposed at said inner surface of said fabric layer, said barrier layer having an inner surface and an outer surface, and an electric heating/warming element comprising a flexible, electricity-conducting film, disposed between said outer surface of said barrier layer and said inner surface of said fabric layer, said electric heating/warming element being washable, non-swelling and hydrophobic and adapted to generate heating/warming when connected to a power source.

2. The electric heating/warming composite fabric article of claim 1, wherein said electric heating/warming element is disposed upon said outer surface of said barrier layer.

3. The electric heating/warming composite fabric article of claim 1, wherein said outer surface of said barrier layer is secured at least adjacent to said inner surface of said fabric layer.

4. The electric heating/warming composite fabric article of claim 2, wherein said outer surface of said barrier layer is secured upon said inner surface of said fabric layer.

5. The electric heating/warming composite fabric article of claim 1, wherein said electric heating/warming element is stretchable.

6. The electric heating/warming composite fabric article of claim 1, wherein said fabric layer is hydrophobic.

7. The electric heating/warming composite fabric article of claim 1, wherein said fabric layer is hydrophilic.

8. The electric heating/warming composite fabric article of claim 1, wherein said barrier layer is micro-porous hydrophobic.

9. The electric heating/warming composite fabric article of claim 1, wherein said barrier layer is nonporous hydrophilic.

10. The electric heating/warming composite fabric article of claim 1, wherein said barrier layer is nonporous hydrophilic.

11. The electric heating/warming composite fabric article of claim 1, wherein said barrier layer is formed of polyurethane.

12. The electric heating/warming composite fabric article of claim 1, wherein said barrier layer is formed of poly tetrafluoroethylene (PTFE).

13. The electric heating/warming composite fabric article of claim 1, wherein said barrier layer is resistant to passage of air and water droplets and permeable to water vapor.

14. The electric heating/warming composite fabric article of claim 1, wherein said electric heating/warming element is resistant to stiffening and cold crack.

15. The electric heating/warming composite fabric article of claim 1, wherein said electric heating/warming element has resistivity in the range of about 100 ($1\times10^{2}$) ohm-cm to 0.000001 ($1\times10^{-6}$) ohm-cm.

16. The electric heating/warming composite fabric article of claim 1, wherein said electricity-conducting film comprises synthetic resin.

17. The electric heating/warming composite fabric article of claim 16, wherein said electricity-conducting film further comprises conductive particles.

18. The electric heating/warming composite fabric article of claim 17, wherein said conductive particles comprises at least one of silver and graphite.

* * * * *